US010803732B2

(12) United States Patent
Penney

(10) Patent No.: US 10,803,732 B2
(45) Date of Patent: Oct. 13, 2020

(54) SMOKE DETECTOR REMOTE TEST APPARATUS

(71) Applicant: Tyco Fire & Security GmbH, Neuhausen am Rheinfall (CH)

(72) Inventor: Stephen Penney, Middlesex (GB)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 16/340,024

(22) PCT Filed: Oct. 12, 2017

(86) PCT No.: PCT/EP2017/076127
§ 371 (c)(1),
(2) Date: Apr. 5, 2019

(87) PCT Pub. No.: WO2018/069473
PCT Pub. Date: Apr. 19, 2018

(65) Prior Publication Data

US 2020/0035088 A1 Jan. 30, 2020

Related U.S. Application Data

(60) Provisional application No. 62/407,217, filed on Oct. 12, 2016.

(51) Int. Cl.
*G08B 29/14* (2006.01)
*G08B 17/10* (2006.01)

(52) U.S. Cl.
CPC ..... *G08B 29/145* (2013.01); *G08B 17/10* (2013.01)

(58) Field of Classification Search
None
See application file for complete search history.

(56) References Cited

U.S. PATENT DOCUMENTS 2,627,064 A * 1/1953 Allen ..... G08B 29/145 340/515
5,170,148 A 12/1992 Duggan et al.
5,363,857 A * 11/1994 Howard ..... A61B 5/02055 600/531
5,523,744 A * 6/1996 Wieser ..... G08B 29/145 340/630

(Continued)

FOREIGN PATENT DOCUMENTS

CN 101965302 2/2011
JP 2012198753 10/2012

(Continued)

OTHER PUBLICATIONS

International Search Report and Written Opinion, dated Feb. 6, 2018, from International Application No. PCT/EP2017/076127, filed on Oct. 12, 2017. 12 pages.

(Continued)

*Primary Examiner* — Chico A Foxx
(74) *Attorney, Agent, or Firm* — HoustonHogle LLP

(57) ABSTRACT

A smoke detector test apparatus comprises an aerosol generator; a reservoir for holding a test fluid; a compressor for pressurising the test fluid in the reservoir; and a valve for releasing a measured dose of the test fluid from the reservoir to the aerosol generator for aerosolization of the measured dose of the test fluid.

13 Claims, 6 Drawing Sheets

(56) References Cited

U.S. PATENT DOCUMENTS 5,670,946 A * 9/1997 Ellwood ..... B65D 83/30 222/402.13
6,423,962 B1 * 7/2002 Pepper ..... G08B 29/145 250/222.1
6,462,655 B1 * 10/2002 Ha ..... G01F 25/0007 137/551
7,167,098 B2 * 1/2007 Siber ..... G08B 29/145 340/514
8,413,530 B2 * 4/2013 Roby ..... G09B 19/00 73/861
2002/0044061 A1 * 4/2002 Johnston ..... G01N 33/004 340/628
2002/0134131 A1 * 9/2002 Pepper ..... G08B 29/145 73/1.01
2002/0140321 A1 * 10/2002 Waterfield ..... H01L 41/053 310/330
2003/0214199 A1 * 11/2003 Heim ..... F04B 35/045 310/309
2004/0242956 A1 * 12/2004 Scorvo ..... A61F 2/0022 600/30
2007/0145069 A1 * 6/2007 Lazzarini ..... G08B 29/145 222/4
2007/0186618 A1 * 8/2007 Ackerman ..... B65D 83/20 73/1.06
2008/0069732 A1 * 3/2008 Yi ..... F04B 43/00 422/82.01
2008/0245985 A1 * 10/2008 Heim ..... F16K 99/0001 251/129.06
2009/0308134 A1 * 12/2009 Pepper ..... G08B 29/12 73/1.06
2010/0282327 A1 * 11/2010 Roby ..... G09B 19/00 137/1
2011/0094294 A1 * 4/2011 Townsend ..... G08B 29/145 73/37
2012/0227820 A1 * 9/2012 Poster ..... F01M 1/18 137/1
2013/0199260 A1 * 8/2013 Rote ..... G08B 29/126 73/1.06
2017/0045153 A1 * 2/2017 Scheibe ..... F16K 31/006

FOREIGN PATENT DOCUMENTS

WO WO2015/162530 10/2015
WO WO2017/060716 4/2017

OTHER PUBLICATIONS

International Preliminary Report on Patentability, dated Apr. 25, 2019, from International Application No. PCT/EP2017/076127, filed on Oct. 12, 2017. 11 pages.

* cited by examiner

SMOKE DETECTOR REMOTE TEST APPARATUS

RELATED APPLICATIONS

This application is a § 371 National Phase Application of International Application No. PCT/EP2017/076127, filed on Oct. 12, 2017, now International Publication No. WO 2018/069473, published on Apr. 19, 2018, which International Application claims the benefit under 35 USC 119(e) of U.S. Provisional Application No. 62/407,217, filed on Oct. 12, 2016, both of which are incorporated herein by reference in their entirety.

The present invention relates to a smoke detector tester for use in testing smoke detectors in fire alarm systems, and to a method of testing smoke detectors. Smoke detectors are often sited where it is difficult or inconvenient to use conventional methods to test them. For example, the area in which a smoke detector is placed might have restricted access (such as some research or military establishments), or testing of a smoke detector might be disruptive (such as in a continuously occupied hospital ward), or the detector might be in a location which is hazardous to human health (such as certain areas of a nuclear power station), or the smoke detector might be located in a position which is accessible only with special equipment such as ladders, scaffolding or lifts. In such circumstances, smoke detectors might not be tested as frequently as they should, and when they are tested, the cost of testing is very high.

Many modern smoke detectors currently have the capability of monitoring both electrical and operational aspects of their performance automatically The only parameter of operation which isn't automatically tested is whether entry of smoke has been compromised, for example by the build-up of dirt on the air inlet leading to a detector element within the smoke detector. To check this parameter, a test needs to establish the ability for smoke to reach the detector element of the smoke detector.

Known detector testers mount smoke simulators on the end of long poles, such as those disclosed in CN101965302B, U.S. Pat. No. 6,423,962B1 and U.S. Pat. No. 5,170,148A. Such detector testers include a hood at one end of the pole which fits over the body of a detector, and an aerosol can containing a paraffin-based liquid which is released into the hood as an aerosol spray to simulate the presence of smoke particles. These detector testers overcome some of the issues regarding difficult to reach detectors (e.g. detectors mounted on high ceilings), however, they fail to overcome the difficulty of testing detectors in many of the inconvenient places described above. Paraffin is used because an aerosol containing it is relatively stable compared with aerosols of other liquids, and paraffin based aerosols have a high persistence, suitable particle size, refractive index and particle mass. Water is not used because it doesn't form a suitable aerosol for detector testing as the particle mass is too high compared to smoke particles and its behaviour is very different.

Currently, smoke detector testing in remote locations may use a test apparatus that is collocated with the detector. However, there are problems with aerosol generation and maintenance of consumables in such a set up.

One known test device is the Scorpion® tester, which is mounted beside a pre-installed detector. The tester includes a support rail which is attached to the detector that is to be tested, or to the base on which the detector is mounted, a body which contains an aerosol can, and a tube leading from the body to a nozzle head from which an aerosol spray generated by the tester is directed towards the detection chamber of the smoke detector. This known tester uses its own independent power and data cables and test control panel, separate from any pre-installed fire alarm system cabling and fire system control panel. Up to 8 tester units may be connected by the cabling to a single test control panel. The test control panel may be located up to a maximum of 100 metres away from a unit, depending on the type of cable used. To carry out a test of a fire detector, a test technician attends the site of the fire alarm system, and moves the system from its active state into a test mode. To test the detector or detectors, he introduces a power source to the test control panel. The test control panel then causes the tester unit or units to conduct its tests by releasing an aerosol spray from the aerosol can directed at the fire detector. Each fire detector will indicate when it has detected the aerosol. If a fire detector does not detect the aerosol, the technician will investigate further and rectify any problem. Once complete, the technician will remove the power source and return the fire alarm system to its active state. Each tester unit remains in an inert state when not in use.

This tester has several disadvantages which can make it impractical to implement. Firstly, we have found that it suffers from fluid leaks if not maintained in a horizontal position. This is because the test aerosol is generated by means of dripping the test fluid into an airstream under gravity where it becomes atomized and directed out through a nozzle. Secondly, it requires a 'breather' aperture to allow for test fluid volume change, and this can result in evaporation of the test fluid over time. Thirdly, this tester requires the supply of a relatively large amount of power during operation to generate the aerosol, making it relatively expensive to install because it requires its own control & power cabling.

In our international patent application WO 2017/060716, we describe a smoke detector tester having a liquid reservoir, a vibrating mesh type aerosol generator in fluid connection with the liquid reservoir which operates to generate an aerosol of liquid from the liquid reservoir. Even with the tester disclosed in this document, there is a risk that test fluid could evaporate over time.

The present invention seeks to reduce at least some of the problems set out above.

According to a first aspect of the invention, a smoke detector test apparatus comprises an aerosol generator; a reservoir for holding a test fluid; a compressor for pressurising the test fluid in the reservoir; and a valve for releasing a measured dose of the test fluid from the reservoir to the aerosol generator for aerosolization of the measured dose of the test fluid. This aspect of the invention has a number of advantages. Firstly, the presence both of a valve and of an aerosol generator means that the release of the test fluid from the reservoir to the aerosol generator is separated from the aerosolization of the measured dose of the test fluid by the aerosol generator. By doing this, the test fluid can be stored in the reservoir for a very long period of time without it experiencing evaporation. It is only exposed to the air shortly before it is aerosolized by the aerosol generator. Secondly, the release of a measured dose of the test fluid by the valve means that precisely the right amount of the test fluid is aerosolized during a test, thereby reducing waste, ensuring consistency in the testing regime, whilst ensuring that sufficient aerosolization occurs for the test to be completed. Thirdly, it permits the release of the test fluid to occur at a separate time to the aerosolization of the test fluid. Not only might this facilitate the metering of the dose of the test fluid, but it might also reduce the instantaneous power demand required for a test if the power required to drive the valve is drawn at a different time to the power required to drive the aerosol generator.

According to a preferred embodiment, the smoke detector test apparatus further includes a valve metering chamber. This allows the valve to release a measured dose of the test fluid. In most embodiments, the valve includes a valve element, a valve spring, and a valve actuator. This combination of features allows the valve element to be moved by the valve actuator against a spring. The actuator preferably includes an electric coil and a ferromagnetic element arranged to be driven by the electric coil.

In one embodiment, the valve element is a ceramic plate, and the valve further includes a ceramic plate valve seat against which the valve element is located in face-to-face contact and arranged so as to be movable linearly against the valve seat. The use of ceramic plate components has the benefit of low power requirements for their movement because there is very little friction between them. Furthermore, a very good seal can be achieved between them. In the preferred arrangement, the ceramic plate includes a through hole such that, when the through hole is in alignment with the valve seat, fluid is able to pass.

In one embodiment, the valve element includes a head and a shank.

In another embodiment, the valve element is an electroactive polymer. The use of such a material has a very low power requirement which is ideal for this application. In the preferred arrangement, the central part of the electroactive polymer valve element lies against a valve seat to close the valve.

In some of the embodiments, the valve element is positioned to move within the metering chamber, which is a very compact arrangement. In one embodiment, in its closed position, the valve element seals the end of the tube and the entrance to the metering chamber as well.

According to a second aspect of the invention, a method of testing a smoke detector by generating an aerosol from an aerosol generator of a smoke detector test apparatus comprises: activating a valve unit of the smoke detector testing apparatus to move it into an open position; closing the valve unit; and operating the aerosol generator to generate an aerosol. Advantageously, opening the valve permits the fluid to flow into a metering chamber ready to be aerosolized. Thus, release of the fluid and its atomisation may occur in separate steps.

Embodiments of the invention will now be described by way of example only with reference to the drawings in which.

CONCEPT

Figure 1:
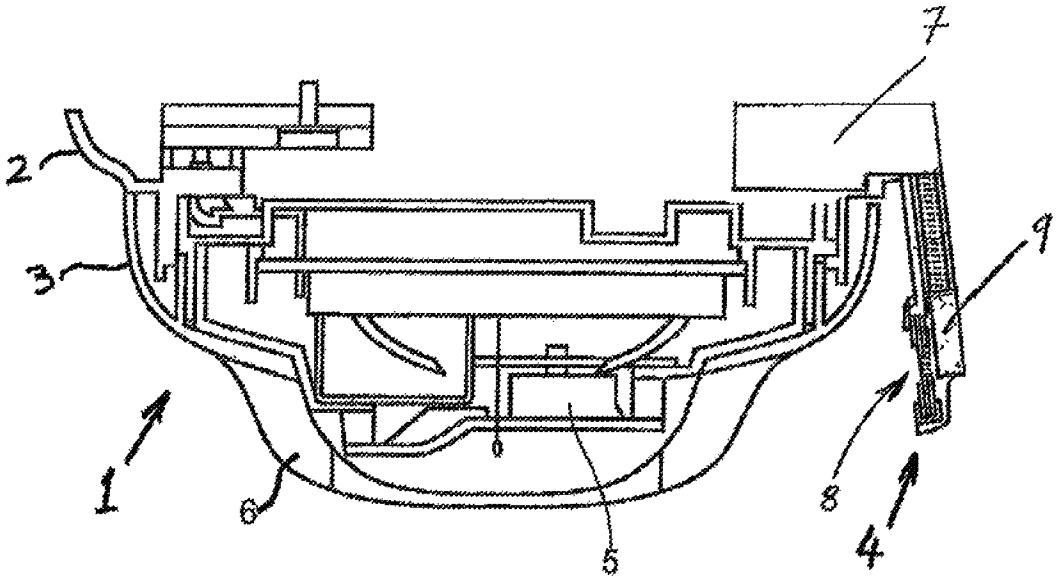
FIG. 1 shows a smoke detector according to a first embodiment of the present invention with a smoke detector test apparatus integrally mounted within and extending from the body of the detector.

The apparatus of the present invention contains a test fluid under pressure due to a mechanism that compresses a fluid reservoir. The fluid is released to the aerosol generating arrangement by means of a microvalve, ensuring that a measured dose just sufficient to generate enough aerosol for the test is made available. The aerosol is generated by means of a technique that ensures that the aerosol created can be directed towards the detector, preferably not through a tube which could become blocked.

Proposed Approach

Reservoir Compression:

The compression of a test fluid may be by means of a separate compression arrangement to either press on a deformable reservoir or move an internal part of a fixed wall reservoir. This may be performed by, but is not limited to, any of the following, or a combination thereof:

Mechanical spring;
Magnetic clamping;
Electrical peristaltic pumping;
Electrically driven ratchet mechanism; or
The reservoir may have an elastic nature.

Microvalve:

The microvalve may be electronically controlled and may be, without limitation, any of:

Solenoid valve;
Piezo operated;
MEMS fluidic control;
Electrostatic;
Servo driven mechanical valve; or
Movement of a fixed magnet
Electro-active polymer.

Aerosol Generating/Transport:

There are a number of known aerosol generation methods, which may be used, although preferred approaches are those which propel the newly generated aerosol forwards during generation, such as any of the following:

1. Ultrasonic;
2. Evaporation condensation;
3. Atomization (nozzles and sprays);
4. Mechanical;
5. Electrostatic generation;
6. Spark discharge;
7. Bubble bursting; or
8. Combustion.

Ultrasonic:

Cavitation—Ultrasonic vibration in a fluid reservoir generates an aerosol above the surface of the reservoir which can be transported by air convection.

Vibrating orifice—A thin liquid stream is emitted under pressure from an orifice, if the orifice is then made to vibrate using an ultrasonic crystal a mono-disperse aerosol can be generated. The aerosol is usually transported away from the generator; but the nature of this aerosol makes it useful as a primary aerosol reference.

Vibrating mesh—A mesh/membrane with 1000-7000 laser drilled holes vibrates at the top of the liquid reservoir, and thereby pressures out a mist of very fine droplets through the holes.

Evaporation Condensation:

Rapid pressure change—A liquid in a container at a high pressure will undergo evaporation and condensation into a mist if the pressure is suddenly reduced.

Heating/cooling—This is the process that occurs naturally out of the spout of a kettle; but also in steam cleaning machines etc.

Propellant—Liquefied gas propellant mixed with the aerosol material is released from a pressurised container, on release the propellant evaporates leaving the material in an aerosol form.

Atomisation:

When a gas is injected under pressure through a tube with a decreasing section, it speeds up, generating a pressure drop at the narrowest point (Bernoulli). The reduced pressure, due to the pressure difference between the two points, sucks up a liquid from a reservoir through a narrow tube into the moving gas flow, and projects it forward as a fine spray of droplets. A number of different nozzle types can be used to control the type size and to some extent stability of the aerosol produced:

Shaped Orifice

Surface impingement—Basically 'reflects' spray off a surface, tends to produce a smaller droplet size.

Pressure swirl—shape of nozzle causes the aerosol to entrain external air. Not so useful for small aerosol sizes.

Mechanical Atomisation:

A spinning shape is used to disperse liquid, the higher the velocity the smaller the aerosol size.

Electrostatic:

Liquid is moved along a capillary with an electrostatic field at the tip causing the solution to form ultrafine droplets a gas flow moves these through a deionising radiation with the resulting aerosol coming out neutralized but still predominantly the same size dispersion, (used for precision stuff only).

Spark Discharge:

Conducting materials become dispersed as an aerosol by an electrostatic discharge. This will be familiar to those used to carbon arc lamps etc.

Bubble Bursting:

Basically uses a bubble stream from a capillary, the air used to generate the bubbles having previously been humidified.

Combustion:

Various combustion processes will produce aerosols, from pyrotechnic explosions, to controlled gas burners. These are generally high-energy processes, although there could be a scaling down to allow one to be used in the invention The first part of an embodiment shown below is a fluid reservoir with a sprung internal plate to ensure that the fluid in the reservoir is always under a slightly positive pressure.

FIG. 1 shows a smoke detector 1 which has a detector base 2 designed to be attached to a surface of a building, such as a ceiling or a wall, a detector head 3 attachable to the detector base 2, and a smoke detector test apparatus 4. The detector head 3 contains a smoke detector element 5 located within the body of the detector head 3, and openings 6 through which airborne smoke particles are able to pass which lead to the detector element 5. The smoke detector element 5 might, for example, be an optical smoke detector element. The openings 6 through which the airborne smoke particles are able to pass often includes grilles to impede the entry of insects or large airborne particles which do not originate from a fire. In very dirty environments, grilles can become blocked with dirt, obstructing the entry of smoke particles, thereby limiting the performance of the smoke detector element 5. The detector base 2 is connected to a fire alarm system via cabling which is typically arranged in a loop, each loop beginning and ending at a control panel, (known in Europe as 'control and indicating equipment', or CIE). The loop will normally connect a number of components of a fire alarm system, such as detectors, sounders, alarm buttons and the like. The loop will also provide electrical power to the components. Attachment of the fire detector head 3 to the base 2 connects the fire detector head 3 to the alarm cable loop.

The smoke detector test apparatus 4 includes a fluid reservoir 7 which contains a fluid to be aerosolised, a tube leading downwards from the fluid reservoir 7 to a valve unit 9 and then to an aerosol generator 8. The fluid within the fluid reservoir 7 is intended to travel through the tube to the valve unit 9, and then to the aerosol generator 8. In this embodiment, the fluid reservoir 7 is located substantially within the detector base 2, but the tube extends outwardly from the detector base 2 and around the outside of the fire detector head 3 to the aerosol generator 8 which is located outside of the detector head 3 facing the openings 6 to the smoke detector element 5. The aerosol generator 8 is held in position by a combination of the fluid reservoir 7 and the tube. The aerosol generator 8 is a vibrating mesh type aerosol generator in which the mesh is supported by piezoelectric elements which can be caused to vibrate thereby releasing the liquid located immediately behind the mesh through the holes in the mesh and forming an aerosol. The characteristics of the aerosol, such as the droplet size are a function of the size of the holes in the mesh and the characteristics of the vibrations applied to the mesh by the piezoelectric crystal element. The aerosol generator 8 is a low-power device that is able to atomise the liquid without drawing much power from the fire alarm system cabling. This is important because the fire alarm cabling is very limited in the amount of power that it can supply.

Figure 2:
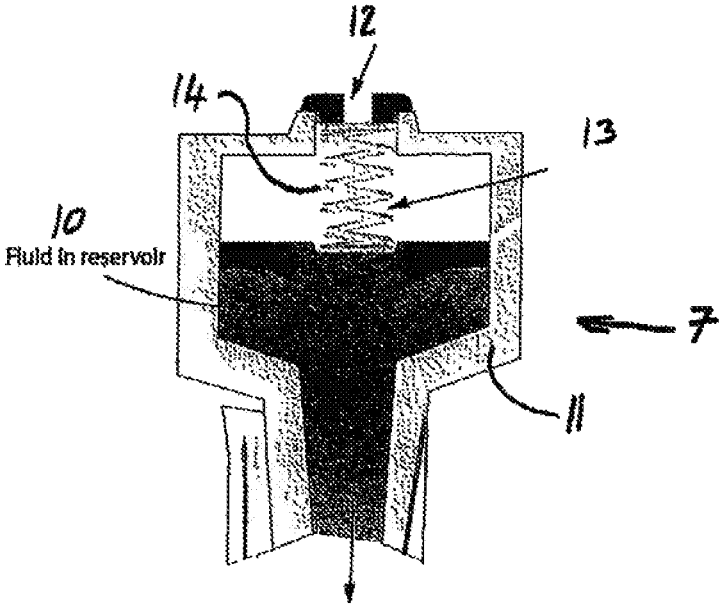
FIG. 2 is a sectional view of a fluid reservoir forming part of a smoke detector test apparatus of an embodiment of the present application.

FIG. 2 shows a fluid reservoir 7 according to one embodiment which holds the fluid 10. The fluid reservoir 7 includes a reservoir body 11 which is rigid, a reservoir vent 12 at the top of the reservoir body 11 to allow entry of air into the reservoir body 11, a pressure plate 13 across the reservoir body but which is able to move through the reservoir body 11 in an airtight manner to separate the fluid 10 within the reservoir beneath it from the air within the reservoir above it. A reservoir spring 14 is disposed between the pressure plate 13 and the top of the reservoir body which biases the pressure plate 13 downwards in order to keep the fluid 10 under slight pressure. The reservoir body 11 leads the fluid in the reservoir towards the aerosol generator 8 downwardly through the tube. As the fluid 10 is consumed, the plate 13 moves downwards under the biasing force of the reservoir spring 14 in order to maintain the slight pressure in the fluid 10 and ensuring that the fluid remains beneath the pressure plate 13. Air enters the reservoir body 11 through the reservoir vent 12 in order to prevent a vacuum from forming above the pressure plate 13 which would inhibit movement.

It will be appreciated that there are other ways of supplying the fluid 10 under slight pressure. For example, the reservoir body could be made of a deformable structure so that it will yield. The side walls might simply be deformable, or the reservoir body 11 might be effected by a bellows like structure which collapses under a force supplied by an external source, such as a spring. This ensures that, as liquid is atomised, it is not replaced within the fluid reservoir 7 by ambient air which might contaminate the liquid within the reservoir.

Figure 3:
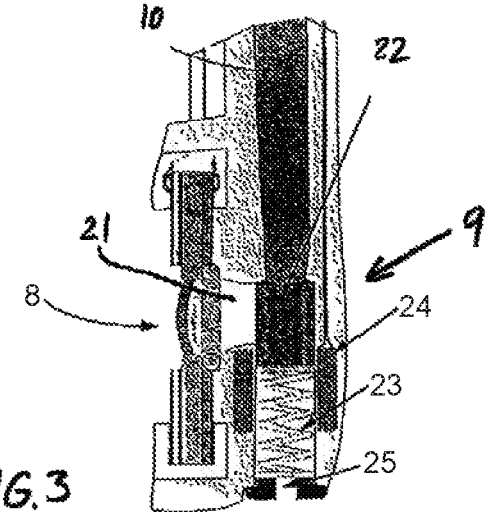
FIG. 3 is a sectional view of an aerosol generator with a valve for releasing a measured dose of a test fluid, with the valve in the closed position, according to a first embodiment of the present invention.
Figure 4:
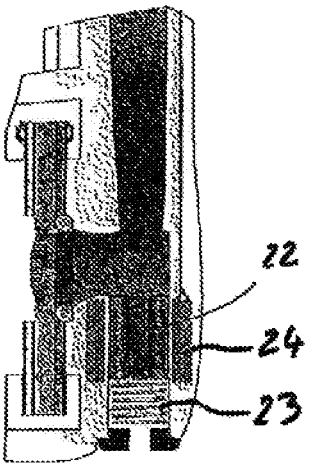
FIG. 4 is a sectional view of the aerosol generator and valve of FIG. 3, but with the valve in the open position.

FIGS. 3 and 4 show the lower part of a smoke detector test apparatus 4 according to one embodiment in which the fluid 10 from a fluid reservoir, such as of the type shown in FIG. 2, is supplied via a tube to a valve unit 9 which controls the supply of the fluid 10 to the aerosol generator 8. In this embodiment, the valve unit 9 comprises a valve metering chamber 21, a valve element 22, a valve spring 23, a magnetic activation coil 24 and a valve vent 25. The valve element 22, in the closed position shown in FIG. 3 is located across the bottom of the tube receiving it, preventing the flow of the fluid 10 into the valve metering chamber 21. The valve element 22 is biased into this position by the valve spring 23. However, the valve element 22 is movable against the bias of the valve spring 23 into a recess which houses the valve spring 23 so as to release the fluid 10 from the tube into the valve metering chamber 21. It will be appreciated that only the volume of liquid sufficient to fill the valve metering chamber 21 can be released because the fluid cannot simply flow through the aerosol generator.

The valve element 22 has a PTFE core to ensure smooth movement and to provide a hydrophobic surface to prevent leakage. It also includes a ferromagnetic metal ring, and is displaced against the valve spring 23 by the energised magnetic activation coil 24 when it is activated by the switching on of a current in that coil. The magnetic actuation coil 24 is located axially offset from the location of the valve element 22 when it is in the closed position such that, when it is energised, it draws the valve element 22 downwards against the spring in order to open the valve and fill the valve metering chamber 21. This is shown in FIG. 4. The valve only needs to be opened for a short period of time in order to fill the valve metering chamber 21. The magnetic actuation coil 24 can then be de-energised to allow the valve element 22 to return to the closed position, and the valve metering chamber 21 remains filled with the fluid 10 until the aerosol generator 8 is operated. It will be noted that, when the valve element 22 is in its closed position, it not only the seals the end of the tube, but it also seals the entrance to the valve metering chamber 21 so as to prevent the fluid from leaking back into the space beneath the valve element 22 where the spring 23 is housed. When the valve element 22 moves between its open and closed positions, air will pass through the valve vent 25 to prevent a vacuum or high pressure air arising below the valve element 22.

When the aerosol generator is activated, the piezoelectric elements supporting the mesh are caused to vibrate, thereby causing the mesh to vibrate, releasing the liquid located immediately behind the mesh through the holes in the mesh to form an aerosol.

Figure 5:
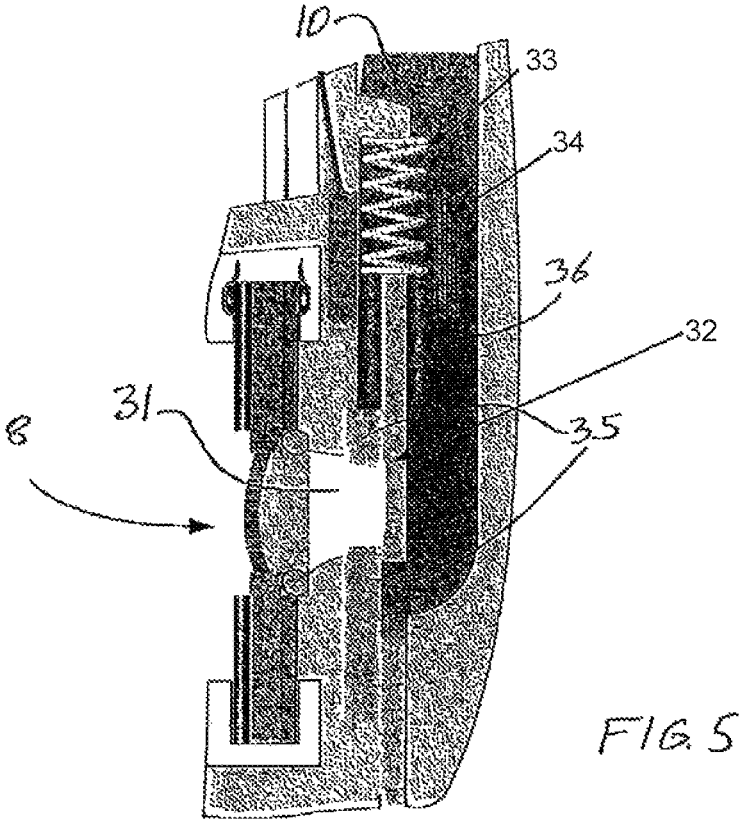
FIG. 5 is a sectional view of an aerosol generator with a valve for releasing a measured dose of a test fluid, with the valve in the closed position, according to a second embodiment of the present invention.
Figure 6:
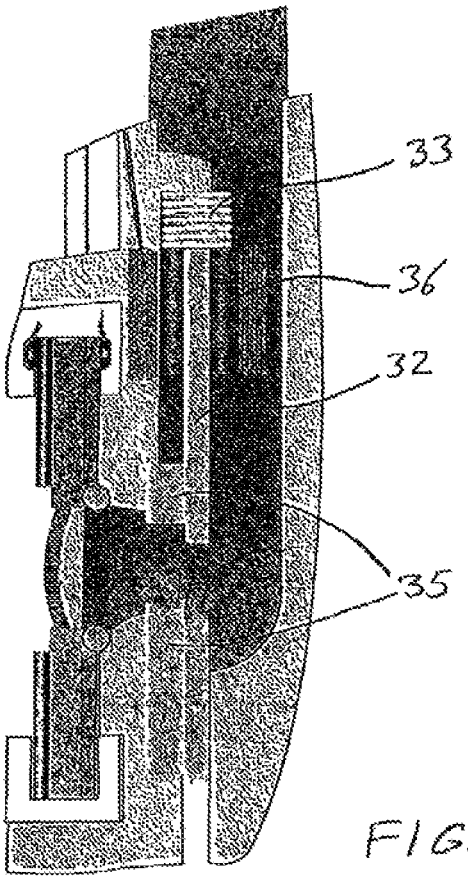
FIG. 6 is a sectional view of the aerosol generator and valve of FIG. 5 with the valve in the open position.

FIGS. 5 and 6 show the lower part of the smoke detector test apparatus 4 according to a second embodiment in which the fluid 10 from a fluid reservoir, such as of the type shown in FIG. 2, is supplied via a tube to a valve unit 9 which controls the supply of the fluid 10 to the aerosol generator 8. In this embodiment the valve unit 9 comprises a valve metering chamber 31, a valve element 32, a valve spring 33, a magnetic activation coil 34, a valve seat 35 and a magnetic core 36. The valve element 32, in the closed position shown in FIG. 5 is located across an opening in the valve seat 35 so as to completely seal that opening closed, preventing the flow of the fluid 10 into the valve metering chamber 31. The valve element 32 is biased into this position by the valve spring 33. However, the valve element 32 is movable against the bias of the spring 33 so as to release the fluid 10 from the tube into the valve metering chamber 31. It will be appreciated that only the volume of liquid sufficient to fill the valve metering chamber 31 can be released because the fluid cannot simply flow through the aerosol generator 8.

The valve element 32 is a ceramic plate having a through hole. The valve seat is also a ceramic plate with the opening in it, and the plates are located in face-to-face contact with each other with the valve element 32 able to move linearly in its plane relative to the valve seat. It is mounted in a channel so that the channel holds the valve element 32 against the valve seat 35 as it moves. In the closed position shown in FIG. 5, the through hole of the valve element 32 does not line up with the opening in the valve seat, but in its open position, the valve element 32 is moved against the spring so as to bring the through hole of the valve element 32 into line with, or at least overlapping with, the opening in the valve seat 35. The magnetic core is attached to one end of the valve element 32, and the magnetic actuation coil 34 is located offset from the location of the magnetic core 36 when the valve element is in the closed position such that, when it is energised, it draws the magnetic core 36 and the valve element 32 to which it is attached upwards against the spring 33 in order to open the valve and fill the valve metering chamber 31. This is shown in FIG. 6. The valve only needs to be opened for a short period of time in order to fill the valve metering chamber 31. The magnetic actuation coil 34 can then be de-energised to allow the valve element 32 to return to the closed position, and the valve metering chamber 31 remains filled with the fluid 10 until the aerosol generator 8 is operated.

In this embodiment, the valve is located within the tube leading from the fluid reservoir 7, or in the fluid reservoir 7 itself. The spring 33 is located within the fluid before it is released into the valve metering chamber 31, and the valve element 32 moves within the liquid, as does the magnetic core 36. The magnetic activation coil 34 is part moulded within the plastic of the fluid channel wall and part located within the fluid reservoir itself.

In this embodiment, the valve element 32 is coated with PTFE to facilitate easy sliding motion against the valve seat 35 and within the channel within which it is mounted. The valve seat 35 is also PTFE coated to facilitate low friction movement of the valve element 32 relative to the valve seat 35.

When the aerosol generator is activated the piezoelectric elements forming the mesh are caused to vibrate, thereby causing the mesh to vibrate, releasing the liquid located immediately behind the mesh through the holes in the mesh to form an aerosol.

Figure 7:
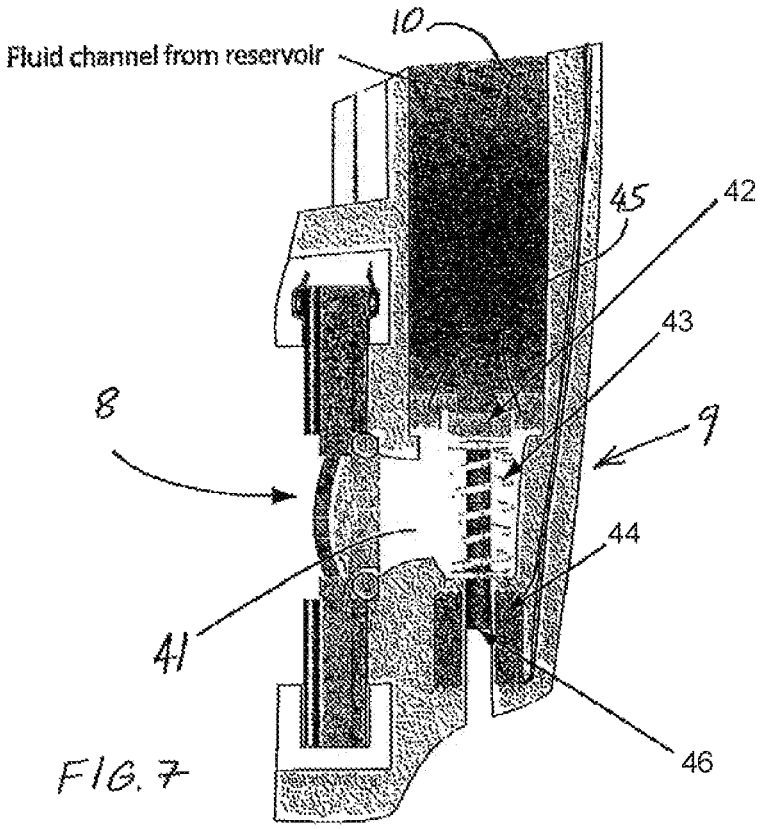
FIG. 7 is a sectional view of an aerosol generator with a valve for releasing a measured dose of a test fluid, with the valve in the closed position, according to a third embodiment of the present invention.
Figure 8:
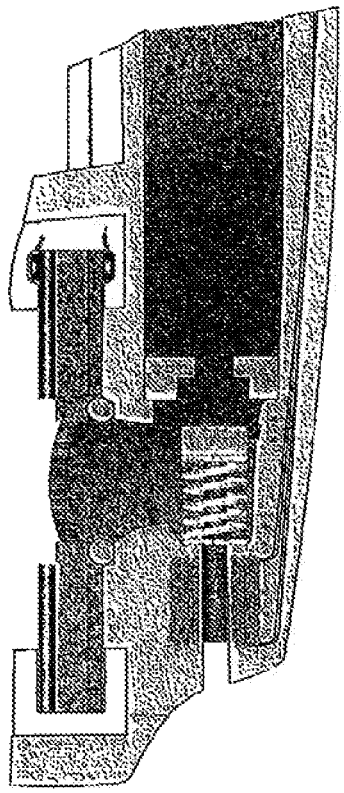
FIG. 8 is a sectional view of the aerosol generator and valve of FIG. 7, with the valve in the open position.

FIGS. 7 and 8 show the lower part of a smoke detector test apparatus 4 according to a third embodiment in which the fluid 10 from a fluid reservoir, such as of the type shown in FIG. 2, is supplied via a tube to a valve unit 9 which controls the supply of the fluid 10 to the aerosol generator 8. In this embodiment, the valve unit 9 comprises a valve metering chamber 41, a valve element 42, a valve spring 43, a magnetic activation coil 44, a valve seat and 45 and a magnetic core 46. The valve seat 45 is located at the bottom of the tube leading the fluid 10 from the reservoir. The valve seat 45 includes an opening which, when the valve is in the closed position of FIG. 7 has the valve element 42 abutting the valve seat 45 so as to close the opening in the valve seat 45. The valve seat 45 is made of a ceramic material with a PTFE coating. The valve element 42 includes a disc shaped ceramic head with a PTFE coating which, in the closed position abuts the valve seat 45 so as to form a seal preventing the passage of the fluid 10 into the valve metering chamber 41. The valve element 42 further includes a shank made of, or including a ferromagnetic core 46 extending from the ceramic head and which is located within a channel in the body of the smoke detector test apparatus. The shank his able to move longitudinally through the channel, but is biased upwardly by the valve spring 43 which urges the ceramic head of the valve element 42 into contact with the valve seat 45. To open the valve, the valve element must be moved downwardly against the spring so that the shank passes through the channel. This is achieved by positioning a magnetic activation coil 44 around the channel longitudinally displaced relative to the position of the magnetic core 46 of the valve element 42 when it is in the closed position such that, when the magnetic activation coil 44 is energised by an electric current, the magnetic core 46 is attracted into the coil drawing the valve element 42 downwardly, thereby opening the valve. The energising the magnetic activation coil releases the valve element 42 so that the valve spring 43 pushes the valve element 42 upwardly to close the valve. FIG. 8 shows the valve in the open position. The valve only needs to be opened for a short period of time in order to fill the valve metering chamber 41. The valve metering chamber 41 remains filled after the valve has been closed until the aerosol generator 8 is operated. It will be noted that the shank of the valve element 42 and the valve spring 43 are located within the valve metering chamber 41.

When the aerosol generator 8 is activated, the piezoelectric elements supporting the mesh are caused to vibrate, thereby causing the mesh to vibrate, releasing the liquid located immediately behind the mesh through the holes in the mesh to form an aerosol.

Figure 9:
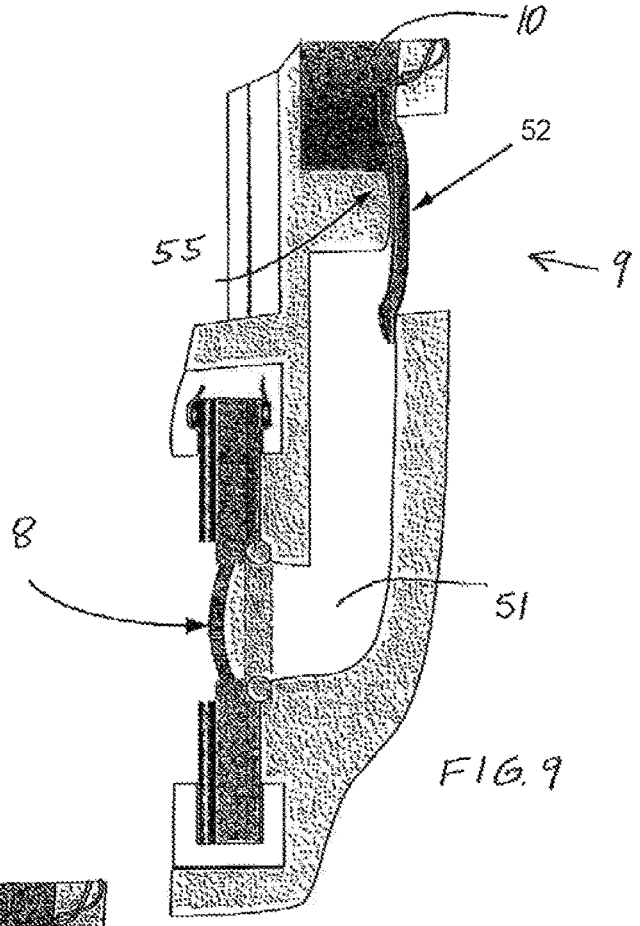
FIG. 9 is a sectional view of an aerosol generator with a valve for releasing a measured dose of a test fluid, with the valve in the closed position, according to a fourth embodiment of the present invention.
Figure 10:
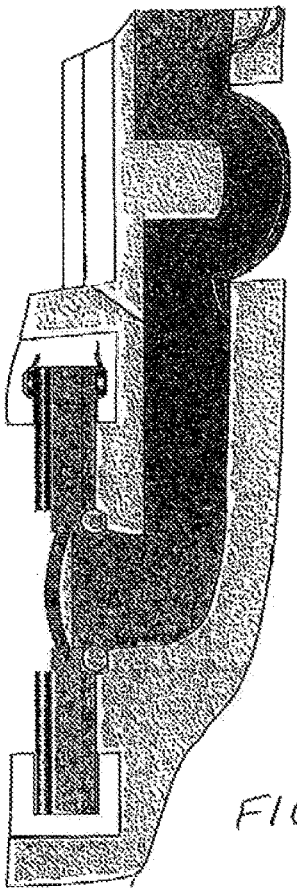
FIG. 10 is a sectional view of the aerosol generator and valve of FIG. 9, with the valve in the open position.

FIGS. 9 and 10 show the lower part of a smoke detector test apparatus 4 according to a fourth embodiment of the present application in which the fluid 10 from a fluid reservoir, such as of the type shown in FIG. 2, is supplied via a tube to a valve unit 9 which controls the supply of the fluid 10 to the aerosol generator 8. In this embodiment the valve unit 9 comprises a valve metering chamber 51, a valve element 52, and a valve seat 55. The valve element 52 is shown in the closed position in FIG. 3 and there is a planar electroactive polymer fixed, at its edges, to the inside of the fluid tube. The valve element 52 includes a central region which, when an electric voltage is applied to it is distorted so as to move from being a generally planar region to one which is dished, opening the valve as is shown in FIG. 10. In its closed position, the central region of the valve element lies against the valve seat 45 so as to block the passage of the fluid 10 from the tube to the valve metering chamber 51.

The valve seat 55 is an abutment which extends across the tube to partially block the flow of the fluid 10 through the tube. When the valve element 52 is in its open position the fluid is able to flow around the valve seat 55 between the valve seat and the valve element 42, but when the valve is closed, the fluid is unable to pass.

When the valve is in the open position, fluid passes through into the valve metering chamber 51, and it will be appreciated that only the volume of liquid sufficient to fill the valve metering chamber 51 can be released because the fluid cannot simply flow through the aerosol generator.

The valve element 52 only needs to be open for a short period of time to allow the valve metering chamber 51 to be filled with the fluid 10.

When the aerosol generator 8 is activated, the piezoelectric elements supporting the mesh are caused to vibrate, thereby causing the mesh to vibrate, releasing the liquid located immediately behind the mesh through the holes in the mesh to form an aerosol.

There are two different ways in which a test might be instigated. The first is automatic where the smoke detector 1 or the control panel automatically instigates a test of the detector. The second is a manually instigated test in which a technician causes the control panel to place the detector into a test mode before a test is carried out. The technician might instigate the test at the individual detector to be tested, from the control panel, or from a remote location such as a monitoring station. In any case, the smoke detector is caused to carry out a test upon receipt of a test signal which might be received from the control panel via the fire alarm cabling, or wirelessly if the smoke detector is installed with wireless communication facilities.

When a test is carried out, the smoke detector is placed in a test mode so that, if it detects a fire condition during the test, it generates a smoke response, but does not cause a fire alarm signal to be sent to any sounders or other alarm notification devices. The smoke detector test apparatus 4 then generates an aerosol from the aerosol generator 8. The first step is the activation of the valve unit 9 to move it to its open position. This permits the fluid 10 to pass, under a small amount of pressure, from the fluid reservoir and the tube through the valve unit 9 into the valve metering chamber. The second step is to close the valve unit 9 which locks off the valve metering chamber so that no further fluid 10 can passed from the reservoir 7. The third step is to operate the piezoelectric elements to cause the mesh to be vibrated and droplets to be emitted from the aerosol generator 8 directed towards the openings 6 of the detector head 3 so as to reach the smoke detector element 5 of the smoke detector 1. The aerosol has smoke-like properties which cause the smoke detector element 5 to generate a smoke response signal. If the detector element 5 does not generate a smoke response signal because it has not received the droplets, a notification is generated which is sent to a service technician who can investigate the reasons why the detector element did not generate a smoke response signal. This might simply be because the grille across the opening to the detector element 5 has become clogged with dirt. The grille can be cleaned and the detector reinstalled. Once the test is complete, the smoke detector 1 is returned to its normal operating condition from the test mode.

The fluid in the fluid reservoir 7 is a weak acid, although other types of water with an ionic content can be used. Aerosolised water behaves similarly enough to smoke to cause the detector 1 to generate a smoke response signal or to go into alarm. The use of a weak acid prevents a static build up on the mesh of the nebuliser. Preferably, the water contains a substance to resist bacterial growth, or is sterilised prior to being placed in the liquid reservoir 7.

The embodiments described above have a number of advantages. Firstly, the fluid 10 within the smoke detector test apparatus for is sealed inside it until it is released by the valve unit 9. This is important because long periods of time can elapse between tests, and it is intended that the volume of the fluid is sufficiently great that a large number of tests can be carried out before the reservoir needs to be refilled. There is a significant cost to refilling the reservoir, particularly when the smoke detector 1 is located in a position which is difficult to access, such as in the roof of the warehouse, or within the ducting of a building. Secondly, the instantaneous power consumption of the smoke detector test apparatus for must be low since it is powered from the fire alarm cabling. The operation of the valve unit 9 can be spaced in time from the operation of the aerosol generator 8 since operation of the valve unit 9 fills the valve metering chamber with the fluid 10 ready for aerosolization. If desired, however, the smoke detector 1 can be installed with a battery or with a capacitor to store electrical power to supplement the power which is supplied by the fire alarm cabling. Thirdly, the metering of the volume of the fluid 10 before operation of the aerosol generator means that the aerosol generator aerosol rises precisely the amount of the fluid 10 that is required to carry out a test. Thus, the aerosolization of an excess amount of the fluid 10 is avoided, thereby maximising the number of tests which can be carried out before the fluid reservoir 7 must be refilled.

Although a number of embodiments have been described, you will be appreciated that some modifications are possible while still falling within the scope of the invention. For example, the valve unit can be any one of a number of different types of valves, most of which have been described in some detail, including a solenoid valve, piezoelectric operated valve, mems fluidic control valve, electrostatic valve, servo driven mechanical valve or the movement of a fixed magnet.

A number of different types of aerosol generator can also be used in addition to the ultrasonic type. These include evaporation condensation, nozzle and spray atomisers, mechanical atomisation, electrostatic aerosol generation, spark discharge, bubble bursting and combustion. One type of ultrasonic aerosol generator has been described, but 3 are commonly available, including ones which operate based on cavitation, a vibrating orifice, and a vibrating mesh. 3 types of evaporation can then station aerosol generators are also known, using rapid pressure change, heating/cooling or propellant to generate the aerosol.

The invention claimed is:

1. A smoke detector test apparatus comprising:
an aerosol generator;
a reservoir for holding a test fluid;
a compressor for pressurizing the test fluid in the reservoir;
a valve metering chamber; and
a valve, arranged to control the flow of fluid in to the valve metering chamber,
wherein moving the valve into an open position enables the test fluid to flow from the reservoir into the valve metering chamber, after which the valve is moved into a closed position such that the valve metering chamber contains only a measured dose of the test fluid, and the aerosol generator generates an aerosol comprising the measured dose of the test fluid.

2. A smoke detector test apparatus according to claim 1, wherein the valve includes a valve element, a valve spring, and a valve actuator.

3. A smoke detector test apparatus comprising:
an aerosol generator;
a reservoir for holding a test fluid;
a compressor for pressurizing the test fluid in the reservoir;
a valve metering chamber; and
a valve, arranged to control the flow of fluid in to the valve metering chamber thereby enabling a measured dose of the test fluid to be released from the reservoir to the aerosol generator for aerosolization of the measured dose of the test fluid, wherein the valve includes a valve element, a valve spring, and a valve actuator, and the valve element includes a head and a shank.

4. A smoke detector test apparatus according to claim 1, wherein the valve includes a valve element which is an electroactive polymer.

5. A smoke detector test apparatus according to claim 4, wherein a central part of the electroactive polymer valve element lies against a valve seat to close the valve.

6. A smoke detector test apparatus according to claim 1, wherein the aerosol generator is arranged such that aerosolization of the test fluid occurs only when the valve is in a closed position.

7. A smoke detector test apparatus comprising:
an aerosol generator;
a reservoir for holding a test fluid;
a compressor for pressurizing the test fluid in the reservoir;
a valve metering chamber; and
a valve, arranged to control the flow of fluid in to the valve metering chamber thereby enabling a measured dose of the test fluid to be released from the reservoir to the aerosol generator for aerosolization of the measured dose of the test fluid, wherein the valve includes a valve element, a valve spring, and a valve actuator, and the valve actuator includes an electric coil and a ferromagnetic element arranged to be driven by the electric coil.

8. A smoke detector test apparatus comprising:
an aerosol generator;
a reservoir for holding a test fluid;
a compressor for pressurizing the test fluid in the reservoir;
a valve metering chamber; and
a valve, arranged to control the flow of fluid in to the valve metering chamber thereby enabling a measured dose of the test fluid to be released from the reservoir to the aerosol generator for aerosolization of the measured dose of the test fluid, wherein the valve includes a valve element, a valve spring, and a valve actuator and the valve element is a ceramic plate, and wherein the valve further includes a ceramic plate valve seat against which the valve element is located in face-to-face contact and arranged so as to be movable linearly against the valve seat.

9. A smoke detector test apparatus according to claim 8, wherein the ceramic plate includes a through hole such that, when the through hole is in alignment with the ceramic plate valve seat, fluid is able to pass.

10. A smoke detector test apparatus according comprising:
an aerosol generator;
a reservoir for holding a test fluid;
a compressor for pressurizing the test fluid in the reservoir;
a valve metering chamber; and
a valve arranged to control the flow of fluid in to the valve metering chamber thereby enabling a measured dose of the test fluid to be released from the reservoir to the aerosol generator for aerosolization of the measured dose of the test fluid, wherein a valve element of the valve is positioned to move within the metering chamber.

11. A smoke detector test apparatus according to claim 10 wherein, in its dosed position, the valve element seals the end of a tube supplying the test fluid from the reservoir and the entrance to the metering chamber.

12. A method of testing a smoke detector by generating an aerosol from an aerosol generator of a smoke detector test apparatus, comprising:

activating a valve unit of the smoke detector testing apparatus to move it into an open position, thereby enabling a test fluid to flow from a reservoir into a valve metering chamber;

closing the valve unit, in order that the valve metering chamber contains only a measured dose of the test fluid; and operating the aerosol generator to generate an aerosol comprising the measured dose of the test fluid.

13. A smoke detector test apparatus according to claim 12, wherein the operating the aerosol generator to generate an aerosol occurs after closing of the valve unit.

* * * * *